US010029821B2

(12) United States Patent
Haverland et al.

(10) Patent No.: US 10,029,821 B2
(45) Date of Patent: Jul. 24, 2018

(54) RETAINABLE SCOOP AND CONTAINER

(71) Applicant: Ghost, LLC, Henderson, NV (US)

(72) Inventors: Paul Warren Haverland, College Station, TX (US); Daniel Lourenco, Chicago, IL (US)

(73) Assignee: Ghost, LLC, Henderson, NV (US)

( * ) Notice: Subject to any disclaimer, the term of this patent is extended or adjusted under 35 U.S.C. 154(b) by 0 days.

(21) Appl. No.: 15/428,741

(22) Filed: Feb. 9, 2017

(65) Prior Publication Data

US 2017/0225832 A1 Aug. 10, 2017

Related U.S. Application Data

(60) Provisional application No. 62/293,018, filed on Feb. 9, 2016.

(51) Int. Cl.

| | |
|---|---|
| ***B65D 1/40*** | (2006.01) |
| ***B65D 23/12*** | (2006.01) |
| ***B65D 1/02*** | (2006.01) |
| ***B65D 41/04*** | (2006.01) |

(52) U.S. Cl.

CPC ..... *B65D 23/12* (2013.01); *B65D 1/0246* (2013.01); *B65D 41/04* (2013.01)

(58) Field of Classification Search

CPC ..... B65D 23/12; B65D 77/245; B65D 41/56; B65D 41/26; G01F 19/002

USPC ..... 220/735; 206/541

See application file for complete search history.

(56) References Cited

U.S. PATENT DOCUMENTS

| | | | | |
|---|---|---|---|---|
| 5,705,212 | A * | 1/1998 | Atkinson | B65D 51/247 206/542 |
| 5,706,974 | A | 1/1998 | Murdick et al. | |
| 7,175,041 | B2 * | 2/2007 | Ekkert | B65D 51/246 206/541 |
| 9,541,441 | B2 | 1/2017 | Prero et al. | |
| 2012/0205376 | A1 * | 8/2012 | Yang | B65D 51/246 220/212 |
| 2014/0001179 | A1 | 1/2014 | Prero et al. | |
| 2014/0299598 | A1 | 10/2014 | Irani et al. | |

* cited by examiner

*Primary Examiner* — Andrew T Kirsch
*Assistant Examiner* — Don M Anderson
(74) *Attorney, Agent, or Firm* — Fitzsimmons IP Law

(57) ABSTRACT

A container with a scoop. The container is adapted to retain the scoop in an opening of the container so that the scoop remains readily accessible to a user. The opening has a slot or a channel defined in an interior sidewall that is adapted to receive a tab and a free end of a handle that extend from a cup portion of the scoop.

20 Claims, 7 Drawing Sheets

RETAINABLE SCOOP AND CONTAINER

CROSS-REFERENCE TO RELATED APPLICATION

This application claims the benefit of priority of U.S. provisional application No. 62/293,018, filed Feb. 9, 2016, the contents of which are herein incorporated by reference.

BACKGROUND OF THE INVENTION

The present invention relates to containers, such as jars and canisters, and more particularly to containers which contain materials that may be mixed or dispensed according to a measured amount of material.

There are numerous containers in the art that carry products, such as powders, pellets, and liquids, that are combined with other materials according to a measured amount of the product with the other material. The product may be dispensed from the container with a measuring cup or a scoop that is often included within the container with the purchase of the product. In many cases, the scoop may be difficult for the user to retrieve, such as when it has settled in the product during transport or subsequent handling of the container. When confronted with this occurrence, the user must dig through or otherwise extract the contained scoop before it may be used for its intended purpose.

In many instances, the user may elect to retrieve the scoop with their bare fingers. For containers carrying food products, this may present unsanitary handling of the materials. A familiar example of a food product would include coffee grounds or a non-carbonated beverage mix. For containers carrying chemical products, this practice may present health hazards to the individual due to skin contact with the chemicals. In either event, the problem of extricating the scoop may become a recurring problem each time that the user wishes to utilize the scoop.

As can be seen, there is a need for an improved method of providing a measured scoop with a container that eliminates the foregoing problems in the art.

SUMMARY OF THE INVENTION

In one aspect of the present invention, retainable scoop and container includes a containment cavity defined by at least one sidewall and a bottom, a throat opening to the containment cavity; a channel defined in an interior surface of the throat opening; and a scoop having a handle attached to a scoop cup and a tab extending from an opposite side of the scoop cup, wherein a free end of the handle portion and the tab are dimensioned to be received within the channel.

The channel may be defined throughout a circumference of the throat opening. Alternatively, the channel include a first slot dimensioned to receive the tab a second slot dimensioned to receive the free end of the handle portion and support the scoop in the throat opening. The first slot and the second slot are preferably disposed at opposite sides of the throat opening. The Container may also include a lid configured to mate in a sealing engagement with the throat opening. In other embodiments, the container may have a thread defined on an outer surface of the throat opening that engages with a cooperating thread defined on an interior sidewall of the lid.

In other aspects of the invention a retainable scoop has a handle extending from a scoop cup and a tab extending from an opposite side of the scoop cup. A free end of the handle portion and the tab are dimensioned to be received within a channel defined in an interior throat opening of a container. The container may have a containment cavity defined by at least one sidewall and a bottom. A throat opening to the containment cavity has the channel defined in an interior face of the throat opening. Preferably, the channel is defined throughout a circumference of the throat opening. The channel may protrude outwardly from an exterior surface of the throat opening. Alternatively, the channel protrudes inwardly from an interior surface of the throat opening.

In yet other aspects of the invention, a retainable scoop and container includes a containment cavity defined by at least one sidewall and a bottom, a throat opening to the containment cavity. An annular rim is defined in an interior surface of the throat opening. A scoop having a handle attached to a scoop cup and a tab extends from an opposite side of the scoop cup. A free end of the handle portion and the tab are dimensioned to be supported by the annular rim. The annular rim may include a first annular rim and a second annular rim formed in a spaced apart relation defining a channel there between, wherein the tab and the free end of the handle are dimensioned to be received within the channel.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provides a system, method, and apparatus for retaining a scoop within the throat opening of a container during periods of non-use. When the scoop is needed to dispense a product carried by the container, the scoop may be conveniently removed from the container and used.

Figure 1:
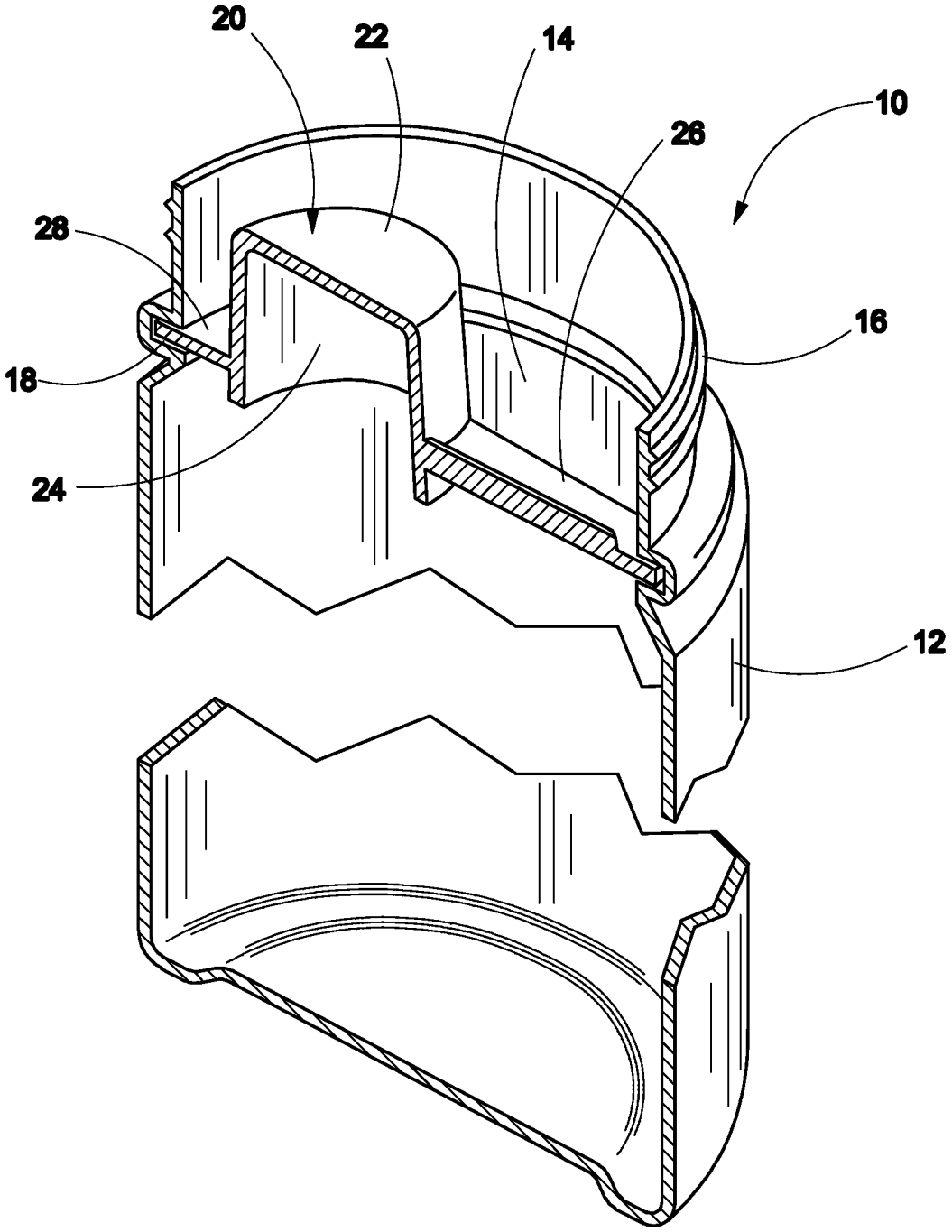
FIG. 1 is a partial sectional view of an embodiment of a retainable scoop and container.
Figure 2A:
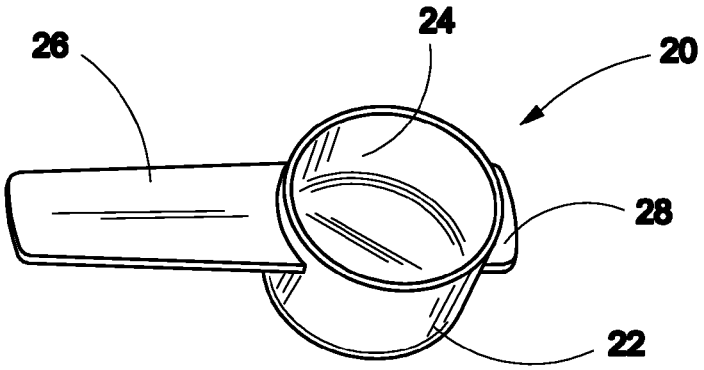
FIG. 2*a* is a top perspective view of the retainable scoop.
Figure 2B:
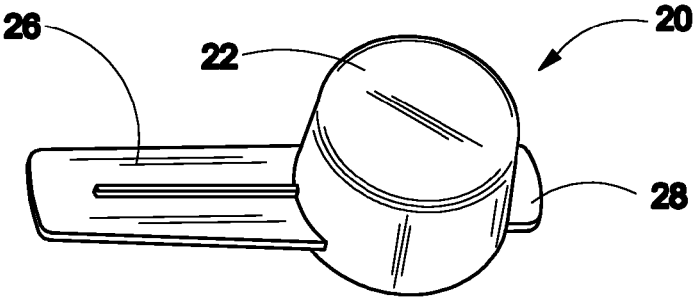
FIG. 2*b* is a bottom perspective view of the retainable scoop.
Figure 3:
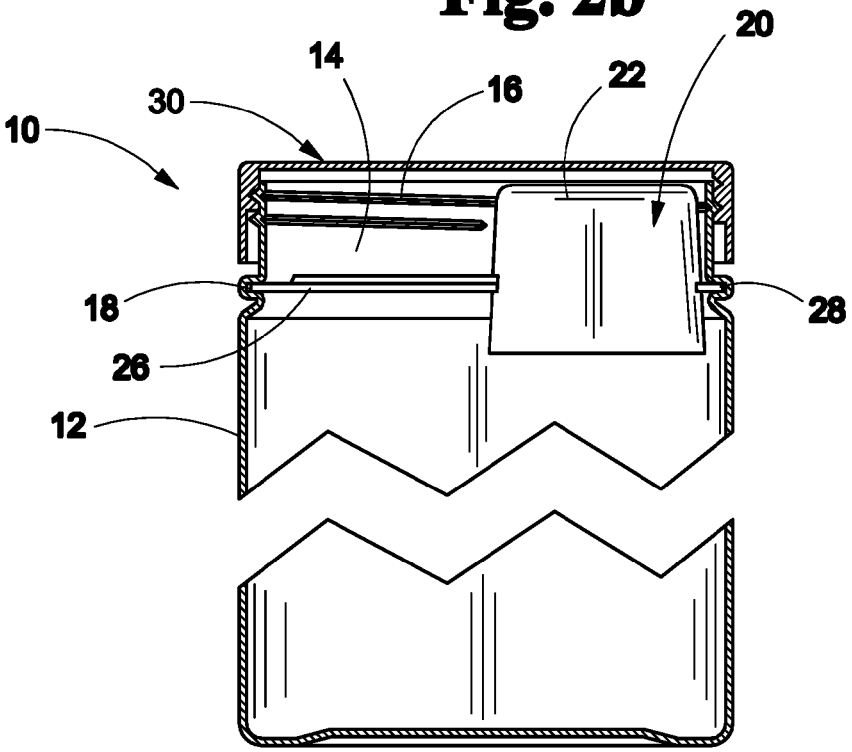
FIG. 3 is a side sectional view of a container and a left side elevation view of the retainable scoop, the right side elevation view being a mirror image thereof.
Figure 4:
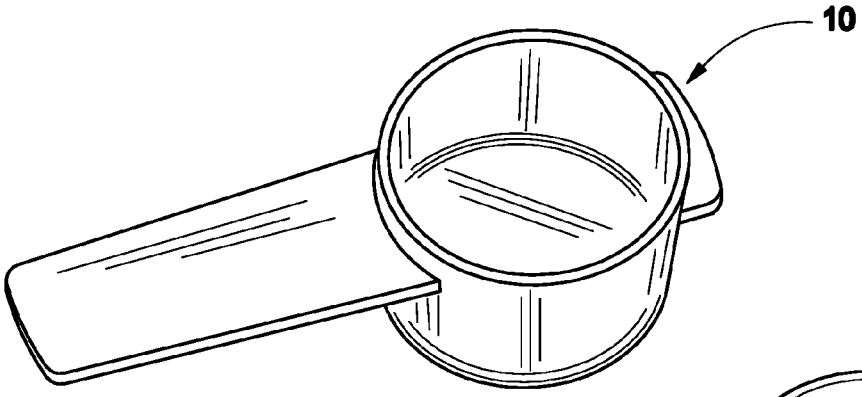
FIG. 4 is an alternative top perspective view of the retainable scoop.
Figure 5:
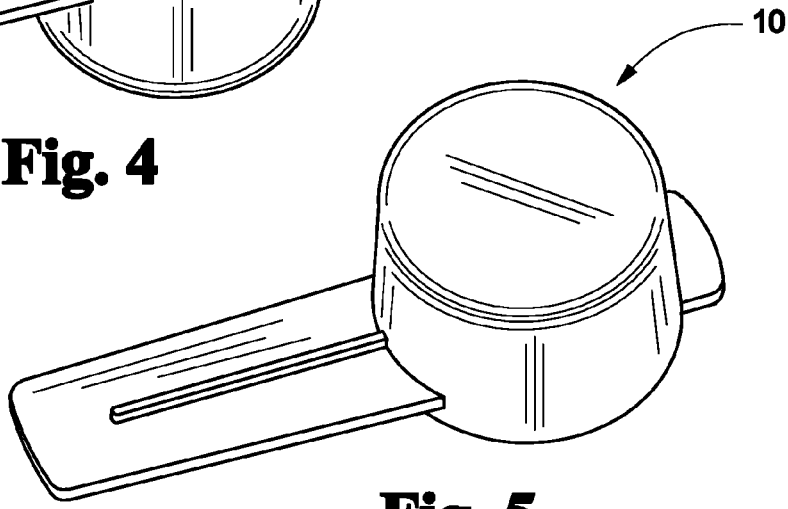
FIG. 5 is an alternative bottom perspective view of the retainable scoop.
Figure 10:
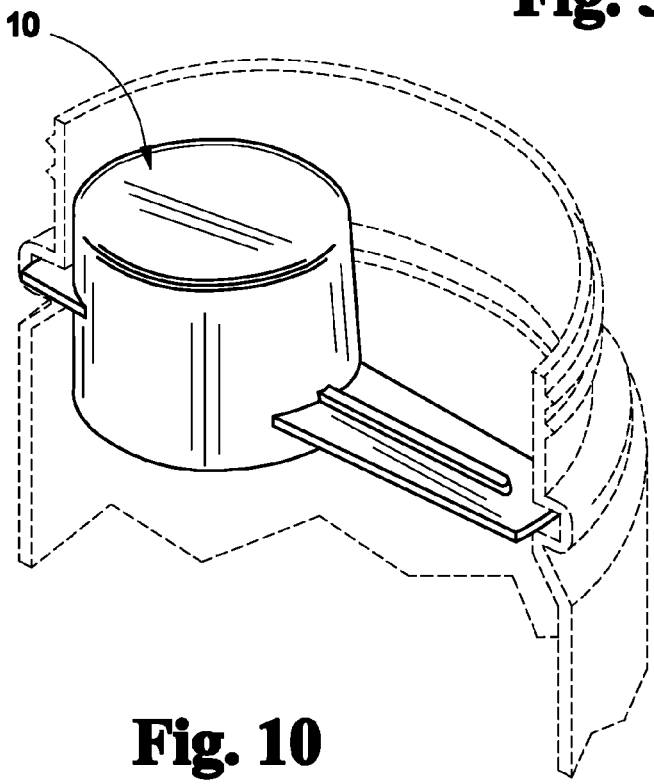
FIG. 10 is a perspective view of the retainable scoop received in a container.
Figure 6:
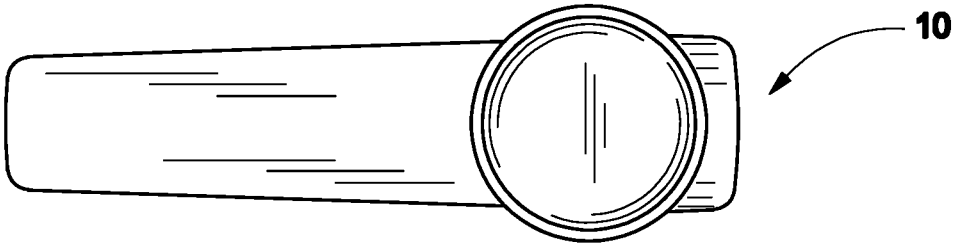
FIG. 6 is a top plan view of the retainable scoop.
Figure 7:
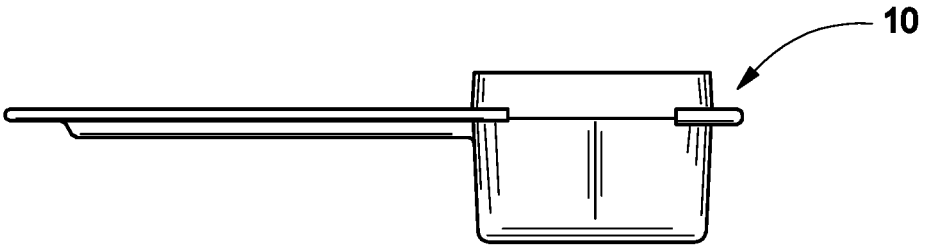
FIG. 7 is a right side elevation view of the retainable scoop, the left side elevation view being a mirror image thereof.
Figure 8:
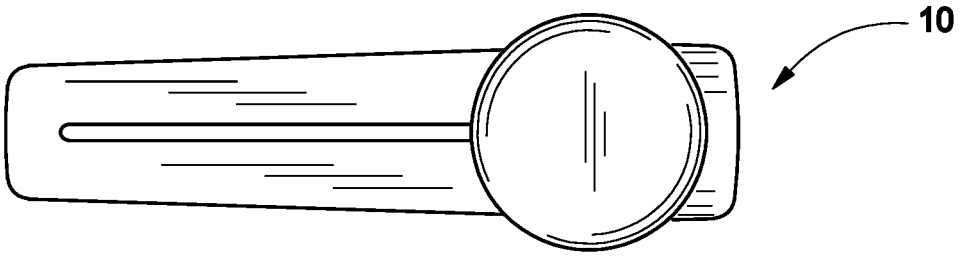
FIG. 8 is a bottom plan view of the retainable scoop.
Figure 9A:
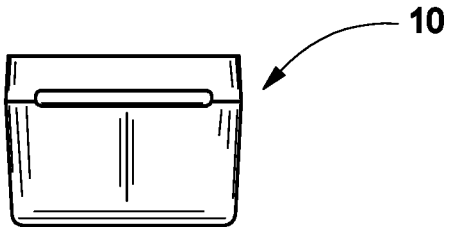
FIG. 9*a* is a front elevation view of the retainable scoop.
Figure 9B:
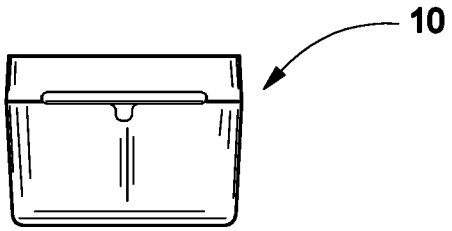
FIG. 9*b* is a rear elevation view of the retainable scoop.
Figure 12:
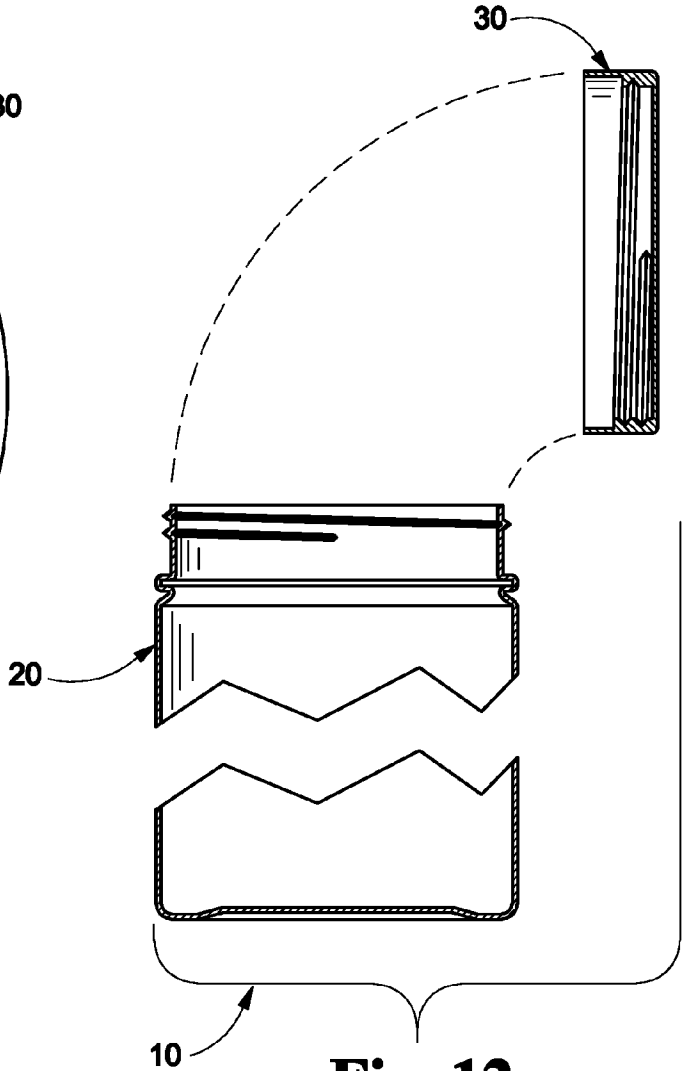
FIG. 12 is a partial side sectional view of a container and side sectional view of a lid.
Figure 11:
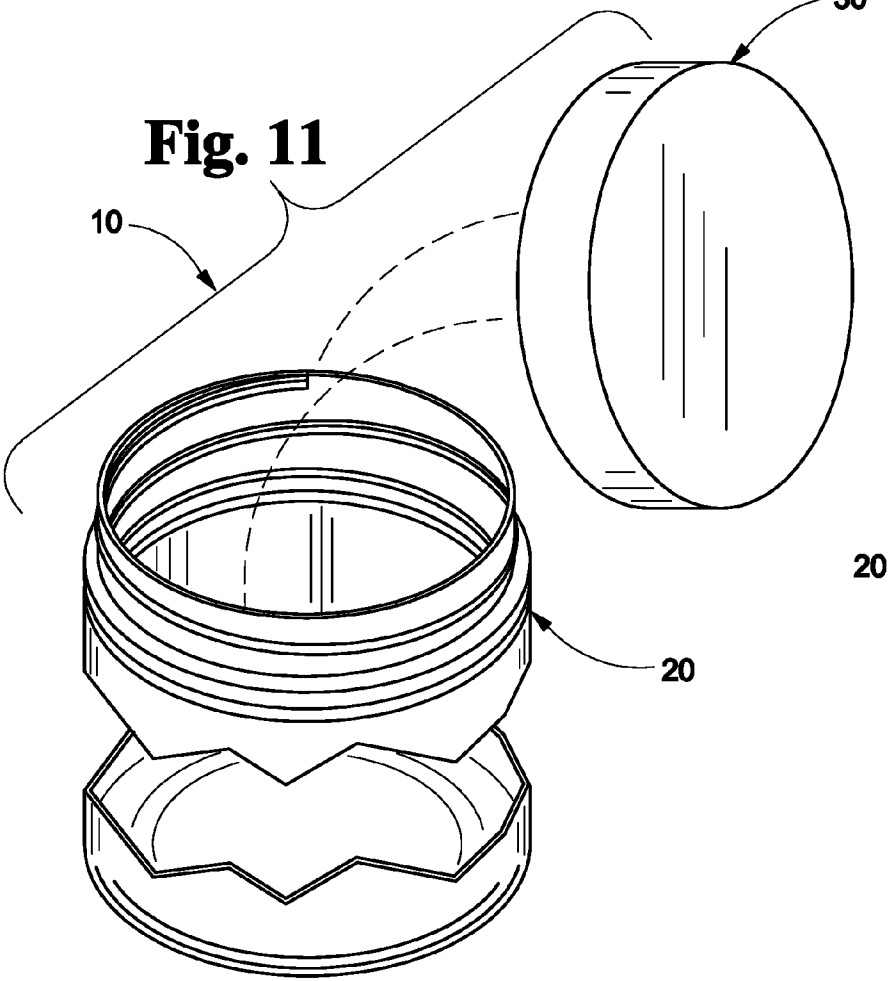
FIG. 11 is an exploded perspective view of a container and lid.
Figure 13:
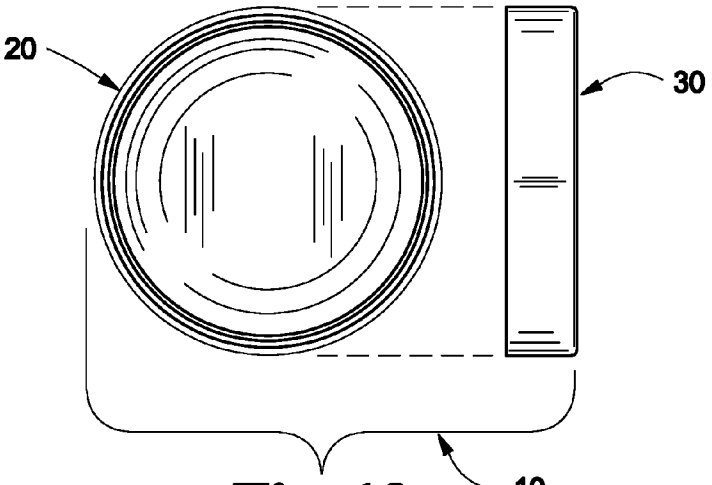
FIG. 13 is an exploded top plan view of a container and a side elevation view of a lid.
Figure 14:
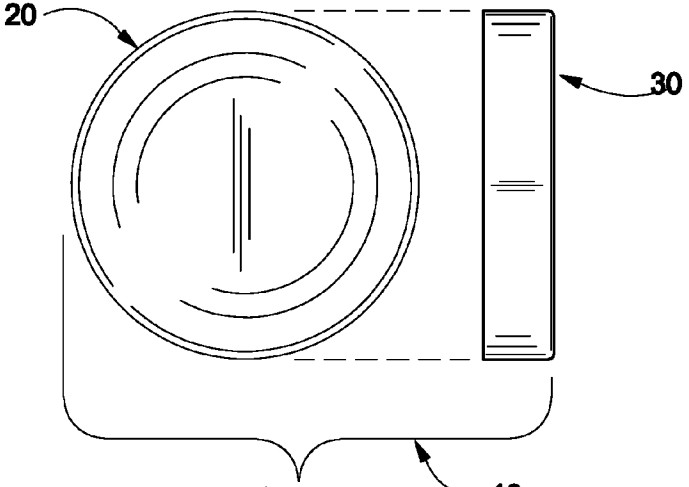
FIG. 14 is an exploded bottom plan view of a container and a side elevation view of a lid.
Figure 15:
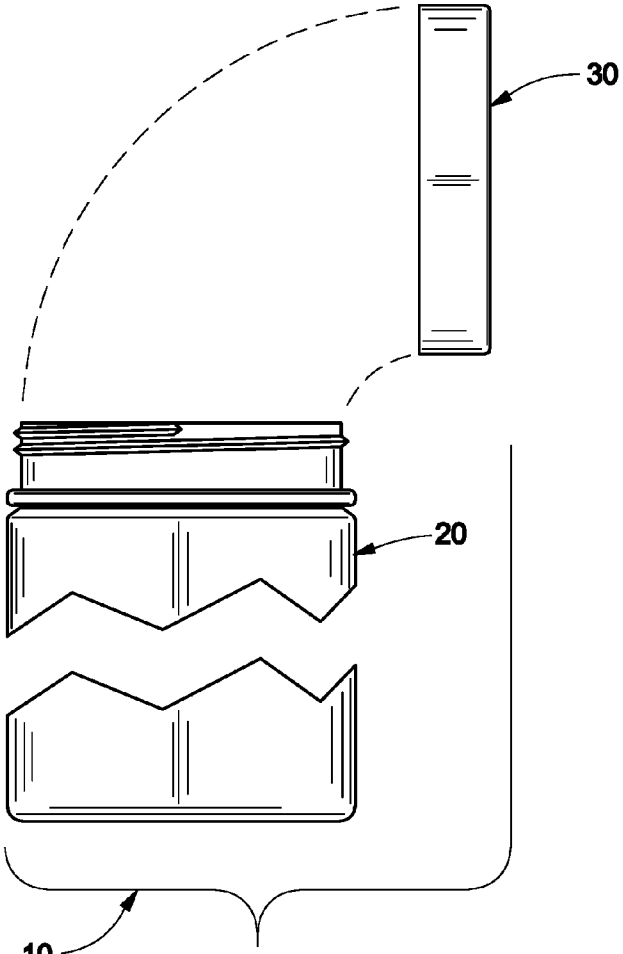
FIG. 15 is a exploded side elevation view of a container and a side elevation view of a lid.
Figure 17:
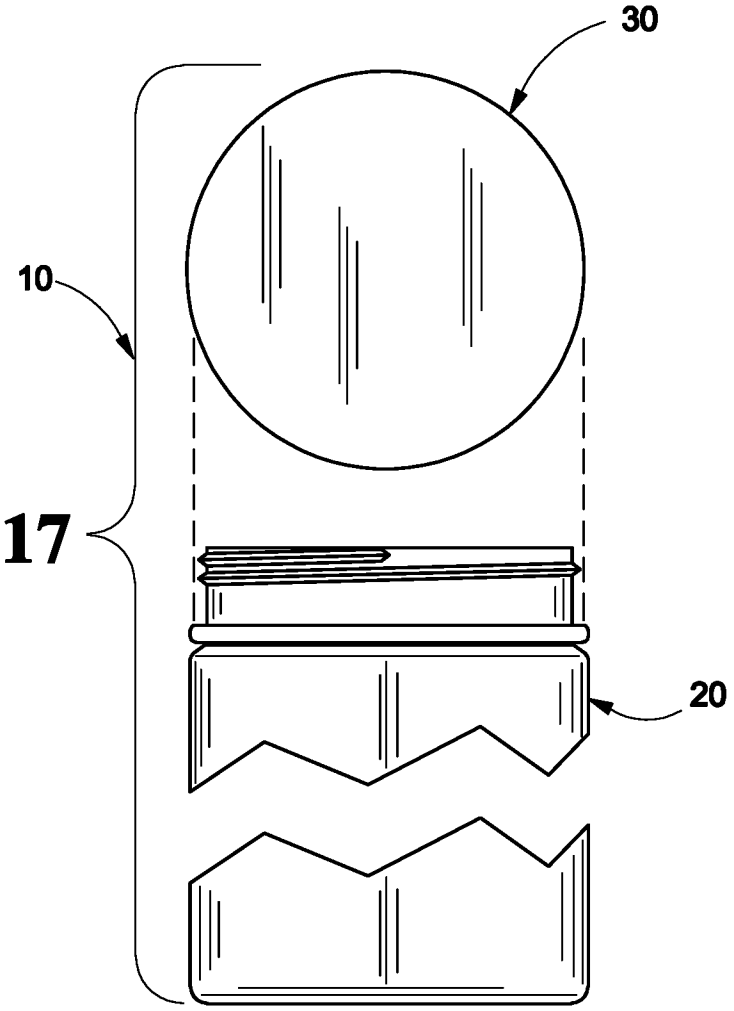
FIG. 17 is an exploded side elevation view of a container and a top plan view of a lid.
Figure 16:
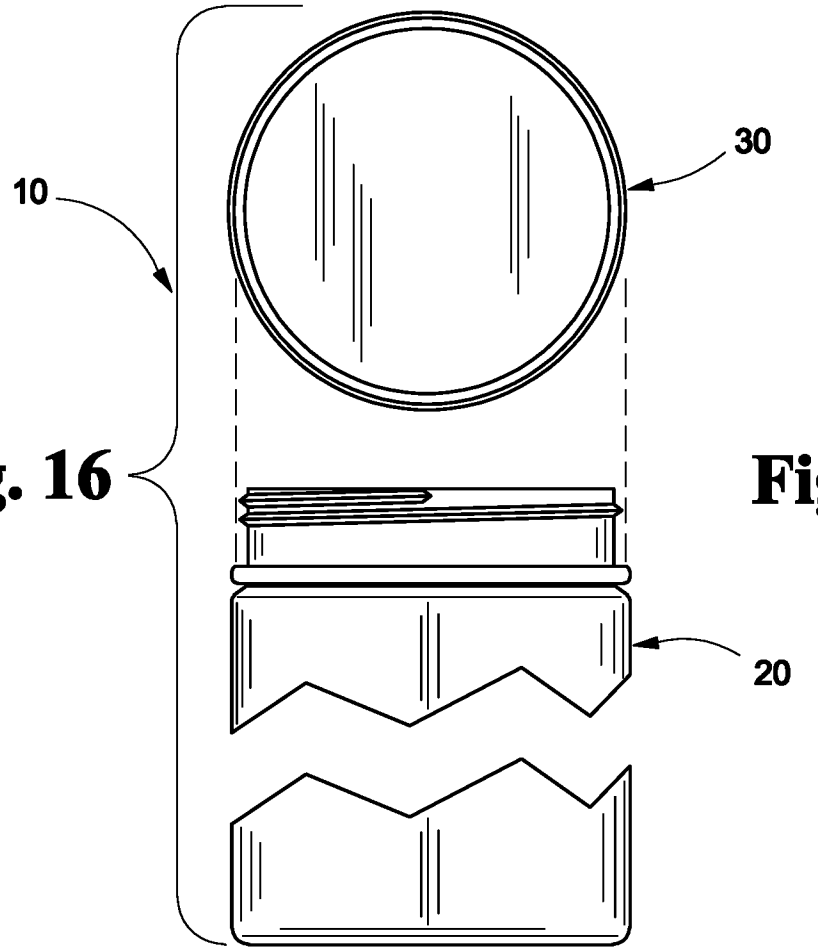
FIG. 16 is a exploded side elevation view of a container and a bottom plan view of a lid.

As will be appreciated in reference to the drawings of FIG. 1, a container 10 is depicted having a containment cavity defined in a lower portion of the container by one or more sidewalls 12. The sidewalls 12 may be configured in almost any geometric shape, such as a rectangle, or the cylindrical shape depicted, to define the containment cavity.

A top portion of the container 10 may include an opening 14 through which access to the materials carried in the container 10 is provided. As with the containment cavity sidewalls 12, a throat opening 16 may be defined by at least one opening sidewall 16. In the embodiment depicted, the opening is substantially circular, or cylindrical. The throat opening 16 may be constricted relative to the container sidewalls 12.

The container 10 will preferably include a removable closure element, such as a lid 30, that is used to prevent spillage, protect the materials from contamination, drying, or other spoilage of the container contents. The lid 30 may be a snap fit lid that removably secures to a rim the throat opening 16. Alternatively, a threaded cap 30, may utilized. In this case, the cap 30 may include a threaded portion 32, or one or more protrusions to engage with a threaded portion defined around the throat 16 of the container 10 that are defined around the opening to the container 10.

The interior of the throat opening 16 to the container 10 includes a plurality of slots 18 or a channel 18 formed in an interior sidewall of the container opening 16. The channel 18 may be formed as an annular rim protruding inwardly towards the interior of the opening 14. Alternatively, the channel 18 may be formed as an annular groove 18 that protrudes outwardly from the outer sidewall of the container throat 16. In other configurations the throat opening 16 may include an annular rim protruding inwardly from the throat opening 16. A first annular rim and a second annular rim may be formed in a spaced apart relation to define a channel 18 there between.

A scoop 20 according to embodiments of the invention includes a cup portion 22, a handle portion 26 extending from the cup portion 22, and a tab 28 extending from an opposed side of the cup portion 22 from the handle portion 26. The cup portion 22 includes an interior cavity that is dimensioned for containing a measured volume of materials carried by the container 10. A free end of the handle portion 26 and a free end of the tab 28 portion are adapted to be received in the slots 18 or channel 18 defined in the opening 14. The tab portion 28 and the handle portion 26 may extend from a top end of the cup portion 22, a bottom end of the cup portion, or any intermediate location between the top end or the bottom end of the cup. A ridge may be defined along a surface of the handle portion 26 to add rigidity to the handle portion 26. The ridge should terminate before reaching the free end of the handle 26 to avoid interfering with the engagement of the handle 26 with the channel 18.

As contemplated by the present invention, the free ends of the tab 28 and the handle 26 are dimensioned to be received within the slots 18 or the channel 18, so as to retain the scoop 20 in an accessible position in the throat opening 16. When the channel is cylindrical, such as that depicted, the free end of the tab 28 and the handle 26 may have an arcuate end face to correspond with the curvature of the channel 18. As will be appreciated, the tab 28 and handle 26 portions of the scoop 20 may be formed so as to be resilient to facilitate snap fitting of the scoop 20 into and out of engagement with the channel 18.

Where the opening 14 has a throat portion 16 between the channel 18 and a top edge of the opening, the scoop 20 may be retained in the channel 18 in an inverted position, such that a base of the scoop 20 is positioned beneath the lid 30 or cap closure element. This is desirable when the container 10 is newly opened and its contents are filled to a level near the top of the containment cavity. This would prevent contact of the scoop portion 22, which may be held by the user from contacting the materials carried in the container 10. As the contents have been dispensed and the fill level is reduced, the scoop 20 may be retained in an upright position.

It should be understood, of course, that the foregoing relates to exemplary embodiments of the invention and that modifications may be made without departing from the spirit and scope of the invention as set forth in the following claims.

What is claimed is:

1. An apparatus, comprising:

a container comprising (i) a containment cavity having a bottom portion configured to rest upon a horizontal surface and side portions oriented perpendicularly with respect to said bottom portion, and (ii) a throat portion having at least one outer ridge on an outer surface of said throat, said at least one outer ridge being configured to mate with a lid, wherein said throat portion comprising an inner aperture allowing a substance to be placed into and removed from said containment cavity; and a scoop comprising a cup having a cup bottom and cup sides, a first substantially flat tab, and a second substantially flat tab, wherein said first tab has a length that is greater than a length of said second tab, a distal end of said first tab is affixed to a first location on said cup sides, a proximal end of said second tab is affixed to a second location on said cup sides;

wherein said container comprises a channel that includes (i) an upper rim, (ii) a lower rim, and (iii) an outer portion that connects an outer end of said upper rim to an outer end of said lower rim, said channel having an opening toward an interior of said container, being located between said containment cavity and said throat portion and below said at least one outer ridge, having an inner diameter that is greater than an inner diameter of said throat portion, and having a width that is greater than a thickness of a proximal end of said first tab and a thickness of a distal end of said second tab;

wherein said proximal end of said first tab slides into a first location in said channel, and said distal end of said second tab slides into a second location in said channel, thereby securing said scoop in relation to said container.

2. The apparatus of claim 1, wherein said side portions comprise a tubular portion, a cross-section of said containment cavity being circular.

3. The apparatus of claim 1, wherein said side portions comprise four side portions, a cross-section of said containment cavity being rectangular.

4. The apparatus of claim 2, wherein said proximal end of said first tab and said distal end of said second tab are arcuate, having degrees substantially equal to the degree of said interior of said container.

5. The apparatus of claim 1, wherein at least one of said first and second tabs are resilient, thereby allowing at least a portion of said scoop to bend when said scoop is being attached to and removed from said container.

6. The apparatus of claim 1, wherein said first location on said cup sides is 180 degrees removed from said second location on said cup sides.

7. The apparatus of claim 6, wherein proximal ends of said cup sides define an aperture in said cup, and said first and second locations on said cup sides are at said proximal ends of said cup sides.

8. The apparatus of claim 6, wherein distal ends of cup sides are affixed to said cup bottom, proximal ends of said cup sides define an aperture in said cup, and said first and second locations on said cup side are between said distal and proximal ends of said cup sides.

9. The apparatus of claim 1, wherein said at least one outer ridge comprises a plurality of outer, spiral ridges, allowing said lid to screw onto said throat portion.

10. An apparatus, comprising:

a container comprising (i) a containment cavity having a bottom portion and a tubular side portion oriented perpendicularly with respect to said bottom portion, and (ii) a throat portion having at least one ridge on an outer surface of said throat portion for mating with a lid, wherein said containment cavity comprising an inner, upward-facing aperture; and a scoop comprising a cup, a first tab, and a second tab, wherein said first tab has a length that is greater than a length of said second tab, a distal end of said first tab is affixed to a first location on said cup, and a proximal end of said second tab is affixed to a second location on said cup;

wherein said container comprises a inwardly-facing channel, said channel having a width that is greater than a thickness of a proximal end of said first tab and a thickness of a distal end of said second tab, being located between said containment cavity and said throat portion, below said at least one ridge on said outer surface of said throat portion, and having an inner diameter that is greater than an inner diameter of said throat portion;

wherein said proximal end of said first tab is configured to mate with a first location in said channel, and said distal end of said second tab is configured to mate with a second location in said channel, thereby securing said scoop in relation to said container.

11. The apparatus of claim 10, wherein at least one of said first and second tabs are resilient, thereby allowing at least a portion of said scoop to bend when said scoop is being attached to and removed from said container.

12. The apparatus of claim 10, wherein said cup has a cup bottom, cup sides, and an upward-facing aperture, and said first location on said cup is 180 degrees removed from said second location on said cup.

13. The apparatus of claim 12, wherein said first and second locations on said cup are on said cup sides adjacent said upward-facing aperture.

14. The apparatus of claim 12, wherein said first and second locations on said cup side are on said cup sides, between ends of said cup sides adjacent said upward-facing aperture and said cup bottom.

15. The apparatus of claim 10, wherein said at least one ridge comprises a plurality of outer, spiral ridges, allowing said lid to screw onto said throat portion.

16. The apparatus of claim 10, wherein said at least one ridge allows said lid to snap-fit onto said throat portion.

17. The apparatus of claim 10, wherein said channel comprises a single annular channel.

18. The apparatus of claim 17, wherein said channel has a circumference that is substantially the same as a circumference of said bottom portion of said container.

19. The apparatus of claim 17, wherein said first tab further includes a ridge that extends perpendicularly from a surface of said first tab, adding rigidity to said first tab.

20. The apparatus of claim 10, wherein said channel is non-annular and comprises first and second slots, said first slot being configured to receive at least said proximal end of said first tab and said second slot being configured to receive at least said distal end of said second tab.

* * * * *